US008720804B1

(12) United States Patent
Pearson

(10) Patent No.: US 8,720,804 B1
(45) **Date of Patent: *May 13, 2014**

(54) GRINDING METHOD AND SYSTEM FOR PRODUCING PARTICLES OF HIGHLY UNIFORM SIZES

(76) Inventor: Alex Pearson, Sioux Falls, SD (US)

( * ) Notice: Subject to any disclaimer, the term of this patent is extended or adjusted under 35 U.S.C. 154(b) by 363 days.

This patent is subject to a terminal disclaimer.

(21) Appl. No.: 13/076,693

(22) Filed: Mar. 31, 2011

(51) Int. Cl.
*B02C 9/04* (2006.01)

(52) U.S. Cl.
USPC ..... 241/10; 241/11; 241/30; 241/34; 241/76

(58) Field of Classification Search
USPC ..... 241/9–11, 30, 34, 81, 77, 78, 79, 76
See application file for complete search history.

(56) References Cited

U.S. PATENT DOCUMENTS 3,226,041 A * 12/1965 Graumann ..... 241/9
3,362,649 A * 1/1968 Odden ..... 241/11
4,202,629 A 5/1980 Jakobs
4,213,855 A 7/1980 Von Bennigsen-Mackiewicz
4,986,997 A * 1/1991 Posner et al. ..... 426/622
5,115,984 A 5/1992 Satake
5,192,028 A 3/1993 Curran
5,201,470 A 4/1993 Baltensperger
5,392,998 A 2/1995 Suessegger
6,199,777 B1 * 3/2001 Satake et al. ..... 241/10
6,372,281 B1 4/2002 Metzger
7,419,694 B2 9/2008 Korolchuk
7,425,344 B2 9/2008 Korolchuk
2006/0073258 A1 4/2006 Korolchuk
2010/0059609 A1 * 3/2010 Teeter et al. ..... 241/11

* cited by examiner

*Primary Examiner* — Mark Rosenbaum
(74) *Attorney, Agent, or Firm* — Jeffrey A. Proehl; Woods, Fuller, Shultz & Smith, P.C.

(57) ABSTRACT

A system for grinding comprises a first grinding apparatus and a sifting apparatus to receive particles from the first grinding apparatus and to remove and divert particles having a size less than a threshold size from a particle path to an output stream such that the particles are not subjected to further grinding. The sifting apparatus comprises a first particle removal stage configured to remove grain particles of a first size and larger, and a second particle removal stage configured to remove grain particles of a second size and larger from the grain path. A second grinding apparatus may be configured to grind grain exiting the sifting apparatus and to output to the sifting apparatus. A method is also disclosed.

20 Claims, 3 Drawing Sheets

GRINDING METHOD AND SYSTEM FOR PRODUCING PARTICLES OF HIGHLY UNIFORM SIZES

BACKGROUND

1. Field

The present disclosure relates to grain processing and more particularly pertains to a new grinding method and system for producing particles of highly uniform sizes.

2. Description of the Prior Art

In the known processing apparatus for grinding grain into livestock feed, the grain is typically passed through a series of grinding apparatus that are progressively more aggressive, and have more teeth per inch and smaller grinder separations, than the previous grinding apparatus in the series, in order to try to achieve the desired grain particle size, which is typically in the range of approximately 200 microns to approximately 1000 microns.

However, when the grain is simply passed through a series of grinding assemblies, there is a tendency to produce material particles with a highly non-uniform size distribution, with some particles having the desired size, but with many particles being ground to a much finer size than is desired (e.g., some particles have a size that is so fine that they are similar to the size of flour) as well as some particles having a size that is significantly greater than the desired size. Thus, while the size of the particles on average may be at the desired size, there is a relatively large standard deviation with respect to that average.

The presence of the "fines" or particles under approximately 200 microns is highly problematic in that, for the purpose of livestock feed, the fine ground particles may cause digestive problems in the livestock such as, for example, causing gastric ulcers in pigs. Furthermore, from an efficiency standpoint, energy most likely has been wasted to grind the particles into this overly fine condition, as well as simply creating dust that is not present if the particles are simply ground to the desired size.

The relatively large standard deviation from the desired size is also problematic, since if fine size particles are present with particles of larger size in a highly non-uniform mixture, the particles are more likely to form blockages (such as bridging) in the feed handling apparatus as the particles of different sizes lock together in a manner similar to the aggregates in concrete.

SUMMARY

In view of the foregoing disadvantages inherent in the known types of grain processing now present in the prior art, the present disclosure describes a new grinding method and system for producing particles of highly uniform sizes which may be utilized for producing a highly suitable grain feed for livestock.

In one aspect, the present disclosure relates to a system for grinding grain into particles, with the system defining a grain path with an input for receiving grain to form a grain stream and an output stream for ground grain particles. The system may comprise a first grinding apparatus configured to grind grain in the grain stream moving along the grain path into grain particles, with the first grinding apparatus having a first output. The system may also comprise a sifting apparatus configured to receive ground grain particles from the first output of the first grinding apparatus and to remove grain particles having a size less than a threshold size from the grain path. The sifting apparatus may divert the ground grain particles less than the threshold size from the grain path to the output stream such that the ground grain particles of the output stream are not subjected to further grinding. The sifting apparatus may comprise a first particle removal stage configured to remove grain particles of a first size and larger from the grain path as grain particles smaller than the first size continue along the grain path, with the first particle removal stage diverting grain particles of the first size and greater to a first diversion path by a first outlet. The sifting apparatus may comprise a second particle removal stage configured to remove grain particles of a second size and larger from the grain path after the grain particles have passed through the first particle removal stage and as grain particles smaller than the second size continue along the grain path, with the second particle removal stage diverting grain particles of the second size and greater to a second diversion path by a second outlet. The system may comprise a second grinding apparatus configured to grind grain exiting the sifting apparatus on the first diversion path by the first outlet. The second grinding apparatus may have a second output in communication with the sifting apparatus such that ground grain particles exiting the second grinding apparatus through the second output are directed to the sifting apparatus.

In another aspect, the disclosure relates to a method for grinding grain into particles in a grain stream on a grain path. The method may comprise grinding grain of a grain stream moving along the grain path into grain particles using a first grinding apparatus having a first output, and sifting grain particles of the grain stream from the first output by a sifting apparatus to remove grain particles from the grain stream having a size less than a threshold size from the grain stream, and diverting a first portion of the grain particles having a size less than the threshold size from the grain path to the output stream such that the first portion of the grain particles of the output stream are not subjected to further grinding. The method may also comprise grinding a second portion of the grain stream from the sifting apparatus by a second grinding apparatus having a second output, and grinding a third portion of the grain stream from the sifting apparatus by a third grinding apparatus having a third output. The method may comprise directing the second portion of the grain particles from the second output of the second grinding apparatus to the sifting apparatus and directing the third portion of the grain particles from the third output of the third grinding apparatus to the sifting apparatus. The method may also include resifting the second portion and third portion of the grain stream by the sifting apparatus to remove grain particles from the grain stream having a size less than a threshold size from the grain stream and diverting grain particles of the second and third portion having a size less than the threshold size from the grain path to the output stream.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
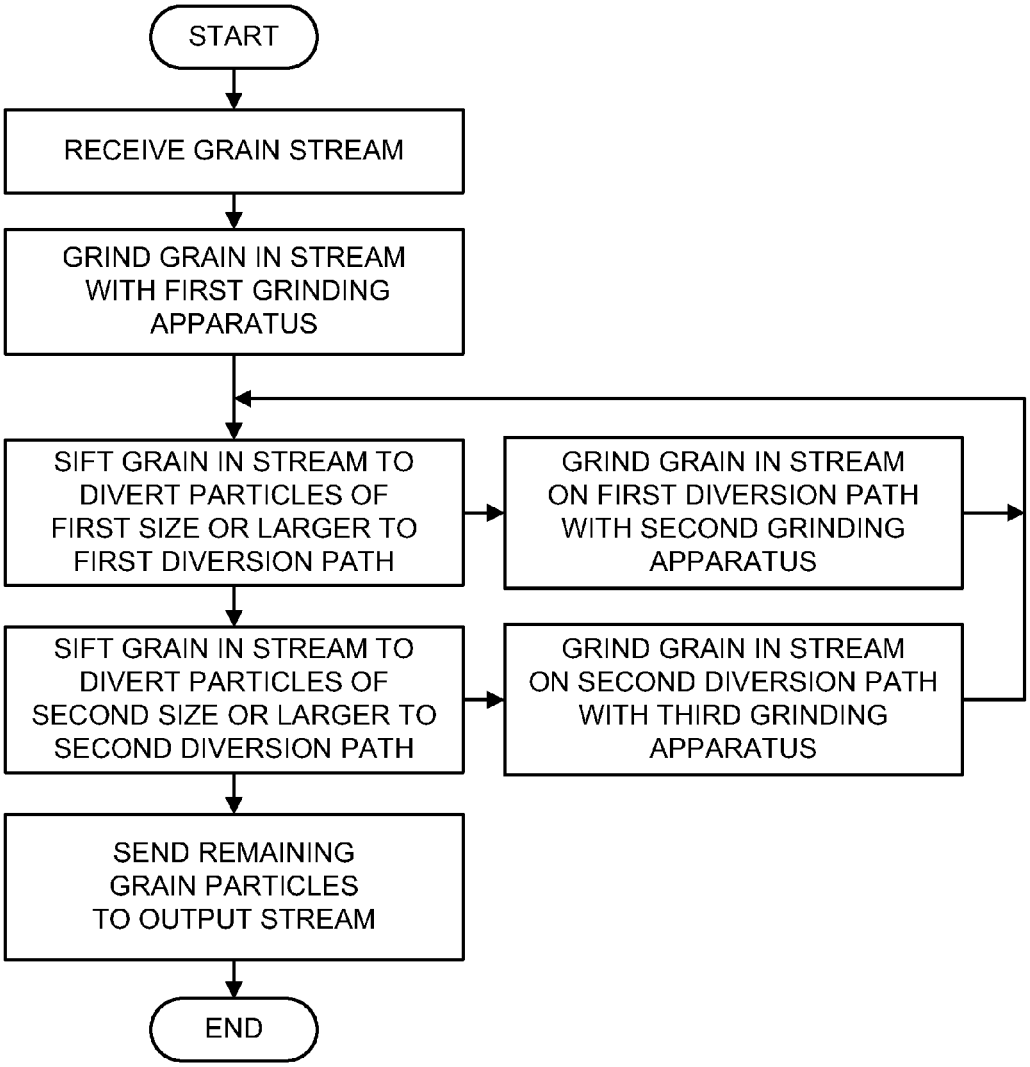
FIG. 1 is a schematic flow diagram of a new grinding method for producing particles of highly uniform sizes according to the present disclosure.
Figure 2:
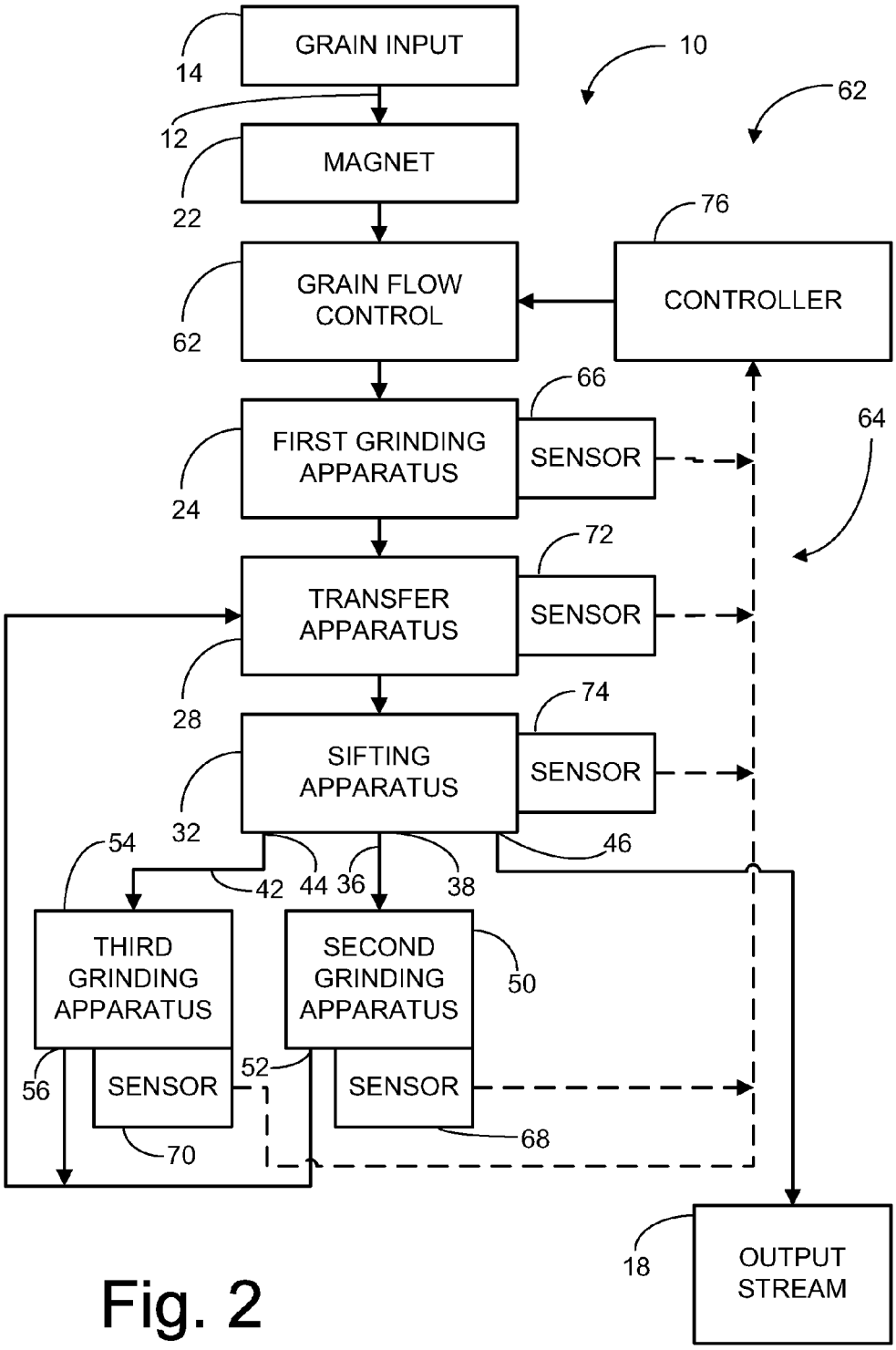
FIG. 2 is a schematic diagrammatic view of the grinding system, according to an illustrative embodiment.
Figure 3:
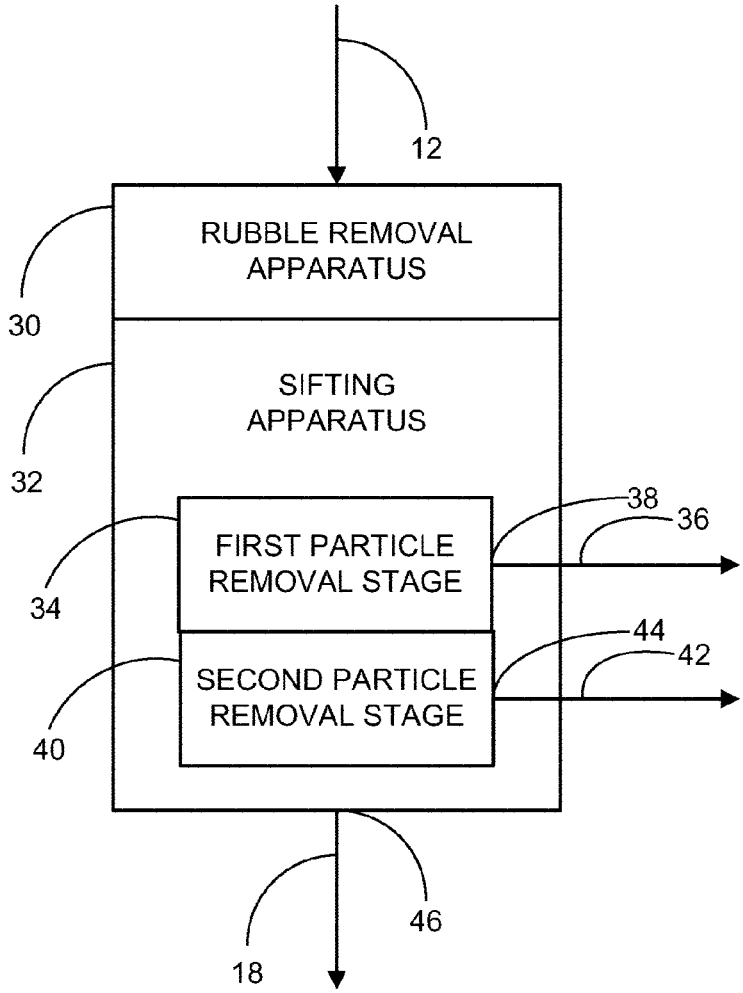
FIG. 3 is a schematic diagrammatic view of the rubble removal and sifting apparatus of the grinding system, according to an illustrative embodiment.

With reference now to the drawings, and in particular to FIGS. 1 through 3 thereof, a new grinding method and system for producing particles of highly uniform sizes embodying the principles and concepts of the disclosed subject matter will be described.

Applicants have recognized that the presence of fines is caused in part by continuing to grind particles that have already been ground to the desired or target size (and therefore require no further grinding) along with particles that still have a size greater than the desired size (and which require further grinding). While in grinding grain into flour for human consumption the production of fines is not problematic because the desired particle size is so small, in the case of grinding grain for livestock feed the desirable size for the particles is significantly larger than in flour production. However, grinding of the grain by a series of grinders is typically necessary since not all of the grain particles will reach the desired size through one pass through a grinding apparatus.

In one aspect, the applicants have developed a system in which particles of the desired or target size or smaller are removed from the stream relatively soon as the particles have reached the desired size but in all cases before the particles are subjected to a subsequent grinding. The target size may be the desired average size for the particles to be produced. The grain particles are sifted to remove particles of the desired size or smaller after each grinding of the particles in the stream before passing through a subsequent grinding apparatus in order to remove particles that have already achieved the desired size (or smaller), and directing those target size (or smaller) particles to an output stream. Therefore, after the grain has passed through a first grinding apparatus, the particles are passed through a sifting apparatus to remove particles that have been ground to the desired size in the first grinding apparatus. Particles from the first grinding apparatus which have not reached the desired size or smaller may be classified into at least one size category to produce at least one stream of grain particles. The stream of grain particles is then passed through another grinding apparatus, then passed through the sifting apparatus and the particles of the desired average size or smaller are removed and the remaining particles are again classified into at least one stream to be passed through a grinding apparatus.

In one aspect, the disclosure relates to a system 10 for grinding grain that is highly suitable for producing grain particles of relatively highly uniform sizes, with a relatively small standard deviation of sizes as compared to the particles produced by prior systems. The system 10 defines a grain path 12 with an input 14 for receiving unground or whole grain, such as shelled corn, to form a grain stream 16. The system 10 produces an output stream 18 of ground grain particles moving through an outlet 20 of the system.

In some embodiments of the system 10, at the input 14 of the system 10 a magnetic material removal apparatus 22 may utilized to remove magnetic material from the grain stream 16 moving along the grain path 12. The grain path 12 may extend through the magnetic material removal apparatus 22 so that grain moving along the path passes through the apparatus 22. The apparatus 22 may comprise a plurality of magnetic rods that are oriented substantially parallel to each other and may be spaced from each other, for example, approximately ⅜ inch. Optionally, other elements and configurations may be utilized for this purpose, and additional or different elements may be utilized to remove foreign objects or debris from the grain stream.

The system 10 may also include a first grinding apparatus 24 configured to grind grain in the grain stream 16 moving along the grain path 12. The first grinding apparatus 24 may receive or take in grain in its original or harvested form and grind the grain into grain particles or pieces that are smaller than the grain received by the apparatus 24. The grain path 12 may extend through the first grinding apparatus 24 such that the grain stream moves through the grinding apparatus 24. The first grinding apparatus 24 may have a first output 26, and typically the grain particles exiting the first output 26 will have a wide variety of sizes. In some of the most preferred embodiments, the first grinding apparatus 24 may comprise a first roller grinder, which may include a pair of grinding rollers separated by a first spacing distance. The rollers of the apparatus 24 may be driven by one or more motors, as well as power transmitting belts and/or gears, and the rollers may be driven at different rotational speeds to enhance the grinding effect. One suitable roller grinder is model no. RMS12X72ADV available from RMS Roller Grinder at 27116 Grummand Ave, Tea, S. Dak. 57064-8113, although other grinding apparatus from other sources may be employed.

A transfer apparatus 28 may be utilized in the system 10 to transfer grain from the first grinding apparatus 24, and may be in communication with the first output 26 of the first grinding apparatus to receive ground grain from the apparatus 24. The transfer apparatus 28 may form a portion of the grain path 12, and may have a substantially horizontal portion and a substantially vertical portion. The transfer apparatus 28 may comprise a conveyor that is configured to move grain along the grain path using, for example, a belt, although other suitable means may be employed such as augers.

In some embodiments of the system 10, a rubble removal apparatus 30 may be employed to remove non-grain or debris particles from the grain stream 16 on the grain path, including debris that was not removed by the magnetic material removal apparatus 22. The rubble removal apparatus may be advantageously positioned on the grain path 12 such that it receives the grain stream from an exit of the transfer apparatus, although the apparatus 30 may be positioned at other locations along the grain path. The rubble removal apparatus 30 may comprise a screen with apertures or openings of suitable size to catch debris yet pass the ground grain particles, and an example of a suitable size is a screen with openings of approximately 1 inch by ⅜ inch. The apparatus 30 may be suitable for removing parts of crop plants other than the grain, such as parts of corn husks, stalks, cobs and the like, from the grain stream 16.

After passing through the first grinding apparatus 24, the stream 16 of grain on the grain path may pass through a sifting apparatus 32 that is configured to remove ground grain particles having a size less than a target size from the grain stream that includes grain particles emanating or exiting from the first output 26 of the first grinding apparatus 24. The target size may be a desired maximum width of the particle to be output by the system 10. The sifting apparatus 32 may function to divert ground grain particles having a size less than the target size from the grain path 12 to the output stream 18, and the ground grain particles of the output stream are not subjected to further grinding by the system 10. Grain particles having sizes greater than the target size are left in the grain stream 16 by the sifting apparatus 32, and in some preferred embodiments, the sifting apparatus performs further size classification of the grain particles on the grain path to create two or more streams of particles on two or more diversion paths.

In the illustrative embodiments of the system 10, the sifting apparatus may comprise a first particle removal stage 34 that is configured to remove grain particles of a first size and larger from the grain path 12 while allowing grain particles smaller than the first size to continue along the grain path. The first particle removal stage 34 may divert grain particles of the first size and greater to a first diversion path 36 with a first outlet 38 of the sifting apparatus 32. In some embodiments, the mesh size of sifting apparatus in the first particle removal stage may be approximately 2000 microns in size. The first particle size of grain particles leaving the first particle removal stage may be in the range of approximately 2000 micron size to approximately 5000 micron size. Further, the sifting apparatus 32 may include a second particle removal stage 40 that is configured to remove grain particles of a second size and larger from the grain path 12 after the grain particles have passed through the first particle removal stage 34, and while allowing grain particles smaller than the second size to continue along the grain path. In some embodiments, the mesh size of sifting apparatus in the first particle removal stage may be approximately 1000 microns in size. The second particle size of grain particles leaving the second particle removal stage may be in the range of approximately 1000 micron size to approximately 2000 micron size. The second size of grain particles is relatively smaller than the first size of grain particles, and the second size is relatively larger than the target size. The second particle removal stage 40 may receive grain particles on the path from the first particle removal stage 34, and may divert grain particles of the second size and greater to a second diversion path 42 with a second outlet 44 of the sifting apparatus. In many preferred embodiments, grain particles that pass through the first particle removal stage 34 and the second particle removal stage 40 are directed to the output stream 18 by a primary outlet 46 of the sifting apparatus, and no further processing by the system is performed on the grain in the output stream by the system.

The system 10 may also include a second grinding apparatus 50 that is configured to grind grain particles exiting the sifting apparatus on the first diversion path 36 by the first outlet 38. The second grinding apparatus 50 may have a second output 52 through which the grain particles ground by the apparatus 50 exit the apparatus 50. The grain particles leaving the second grinding apparatus 50 may be directed back to the sifting apparatus 32 for being sifted again, and in some preferred embodiments the grain particles exiting the apparatus 50 are added to or included with grain particles of the grain stream on the grain path. This may be effected by the second output 52 of the second grinding apparatus 50 being in communication with the transfer apparatus 28 such that grain particles exiting the apparatus 50 are directed to the grain path 12, such as at a point directly prior to the sifting apparatus 32. Thus, the grain stream entering the sifting apparatus may include not only the grain output of the first grinding apparatus 24 but also the grain output of the second grinding apparatus 50.

The second grinding apparatus 50 may comprise a second roller grinder that includes a pair of grinding rollers separated by a second spacing distance. The second grinding apparatus 50 may be similar to the first grinding apparatus 24, but the second spacing distance between the rollers of the apparatus 50 may be less than the first spacing distance between the rollers of the first grinding apparatus. Further, the number of teeth per inch on the rollers of the second grinding apparatus 50 may be greater then the number of teeth per inch on the rollers of the first grinding apparatus 24.

The system may further include a third grinding apparatus 54 that is configured to grind grain exiting the sifting apparatus 32 on the second diversion path 42 by the second outlet 44. The third grinding apparatus 54 may have a third output 56 through which the grain particles ground by the apparatus 54 exit the apparatus 54. The grain particles leaving the third grinding apparatus 54 may be directed back to the sifting apparatus 32 for being sifted again, and in some preferred embodiments the grain particles exiting the apparatus 54 are added to or included with grain particles of the grain stream on the grain path. This addition may be provided by the third output 56 of the third grinding apparatus 54 being in communication with the transfer apparatus 28 such that grain particles exiting the apparatus 54 are directed to the grain path 12 such as at a point directly prior to the sifting apparatus 32. Thus, the grain stream entering the sifting apparatus 32 may include not only the grain output of the first grinding apparatus 24 and the second grinding apparatus 50, but also the grain output of the third grinding apparatus 54.

The third grinding apparatus may comprise a third roller grinder that is similar to the first and second roller grinders, and may include a pair of grinding rollers that are separated by a third spacing distance. While the third grinding apparatus 54 may be similar to the first 24 and second 50 grinding apparatus, the third spacing distance between the rollers of the apparatus 50 may be less than the first and second spacing distances between the respective rollers of the first and second grinding apparatus. The number of teeth per inch on the rollers of the third grinding apparatus 54 may be greater then the number of teeth per inch on the rollers of the first and second grinding apparatus. It should be recognized that the system may include less than three grinding apparatus or more than three grinding apparatus, and that the embodiment described herein with three grinding apparatus is merely illustrative.

One significant aspect of the system 10 is a control apparatus 60 this is configured to control an amount of grain in the grain stream moving along the grain path, and may do so by controlling the flow of unprocessed, or unground, grain moving into the system 10. The control apparatus 60 may include an input control assembly 62 that is configured to control movement of grain into the input 14 of the grain path 12. Illustratively, the input control assembly 62 may comprise a vaned wheel that extends across the grain path at, or towards, the input 14 such that grain moving along the grain path moves through the input control assembly and through the vaned wheel. The speed of movement or rotation of the vaned wheel may control the amount of grain entering and thus moving along the grain path 12 at the input 14. The input control assembly 62 may thus be physically positioned at the input of the grain path.

The control apparatus 60 may also include a sensor assembly 64 for sensing the amounts of grain flow through various components of the system 10. The sensor assembly 64 may comprise a plurality of sensors that are configured to sense the respective amounts of power required or drawn by the components of the system 10 to process the grain stream moving along the grain path.

The plurality of sensors may include a first sensor 66 that is configured to sense electrical power drawn by an electrical motor operating the first grinding apparatus 24, and may include more than one sensor if, for example, more than one motor is employed to operate the apparatus 24. The plurality of sensors may include a second sensor 68 configured to sense electrical power drawn by an electrical motor (or motors) operating the second grinding apparatus 50, and a third sensor 70 that is configured to sense electrical power drawn by an electrical motor (or motors) operating the third grinding apparatus 54.

The plurality of sensors may include additional sensors such as a fourth sensor 72 configured to sense electrical power drawn by an electrical motor that operates an element of the transfer apparatus 28, such as a conveyor of the transfer apparatus. A fifth sensor 74 may be configured to sense power drawn by a motor or motors actuating the sifting apparatus 32. Additional sensors may be employed to monitor other aspects of the operation of the system 10.

The control apparatus of the system may also include a controller 76 that accepts input signals from the various sensors of the control apparatus, and controls the input control assembly 62 based upon the states of the signals from the sensors. Illustratively, the signals from the sensors of each of the components may have a range or window of acceptable values that occur during normal or typical operation of the respective devices under suitable or desirable levels of particle flow in the stream, and if the values of the signals from one or more of the sensors exceeds their respective range of values, then the controller may determine that more grain may be fed into the grain stream, or conversely, that less grain needs to be fed into the grain stream.

The use of the system 10 may produce an output of ground particles with a size distribution that is relatively uniform, having a relatively small variation or standard deviation from the desired particle size. The system is highly suitable for producing desired or target particle sizes that fall within the range of approximately 200 microns to approximately 1000 microns, although may be suitable for desired particle sizes outside of this range. The distribution of particle sizes in the output may be greater attenuated or diminished above an average particle size level, and the occurrence of relatively finer sizes is also diminished, although typically not as significantly as those sizes above the average size. In some implementations, the side of the bell curve for particle size distributions may be substantially reduced or even substantially completely eliminated.

The removal of the suitably-sized or smaller grain particles from the grain stream allows for the operation of the grinders, especially of the second and third grinding apparatus, in a less aggressive manner, by allowing suitable grinding operation to be provided by the rollers of the roller grinders rotating at a relatively slower rotation speed than would be utilized in conventional system. Further, the removal of the relatively finer particles prior to further grinding allows the use of a relatively smaller differential in the rotational speeds between the rollers of the roller grinders. Each and both of these changes in grinder operation are believed to reduce the production of finer particles in the grain stream.

The system and method is highly suitable for producing a output stream of particles having average particles sizes of approximately 300 microns to approximately 1000 microns or more, and is especially suitable for producing an output stream of particles having an average particle size in the range of approximately 300 microns to 800 microns. Further, the standard deviation of particles in these size ranges may be reduced to a range of approximately 2 microns to approximately 10 microns.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A system for grinding grain into particles, the system defining a grain path with an input for receiving grain to form a grain stream and an output stream for ground grain particles, the system comprising:

a first grinding apparatus configured to grind grain in the grain stream moving along the grain path into grain particles, the first grinding apparatus having a first output;

a sifting apparatus configured to receive ground grain particles from the first output of the first grinding apparatus and to remove grain particles having a size less than a threshold size from the grain path, the sifting apparatus diverting the ground grain particles less than the threshold size from the grain path to the output stream such that the ground grain particles of the output stream are not subjected to further grinding;

wherein the sifting apparatus comprises a first particle removal stage configured to remove grain particles of a first size and larger from the grain path as grain particles smaller than the first size continue along the grain path, the first particle removal stage diverting grain particles of the first size and greater to a first diversion path by a first outlet; and wherein the sifting apparatus comprises a second particle removal stage configured to remove grain particles of a second size and larger from the grain path after the grain particles have passed through the first particle removal stage and as grain particles smaller than the second size continue along the grain path, the second particle removal stage diverting grain particles of the second size and greater to a second diversion path by a second outlet; and a second grinding apparatus configured to grind grain exiting the sifting apparatus on the first diversion path by the first outlet, the second grinding apparatus having a second output in communication with the sifting apparatus such that ground grain particles exiting the second grinding apparatus through the second output are directed to the sifting apparatus.

2. The system of claim 1 additionally comprising a third grinding apparatus configured to grind grain exiting the sifting apparatus on the second diversion path by the second outlet, the third grinding apparatus having a third output in communication with the transfer apparatus such that ground grain particles exiting the third grinding apparatus through the third output are directed to the sifting apparatus.

3. The system of claim 2 wherein the third grinding apparatus comprising a third roller grinder.

4. The system of claim 1 wherein the second particle removal stage receives grain particles from the first particle removal stage.

5. The system of claim 1 additionally comprising a magnetic material removal apparatus configured to remove magnetic material from the grain stream on the grain path.

6. The system of claim 1 wherein the first grinding apparatus comprises a first roller grinder.

7. The system of claim 1 additionally comprising a transfer apparatus configured to transfer grain from the first grinding apparatus to the sifting apparatus.

8. The system of claim 1 wherein the transfer apparatus comprises a conveyor configured to move grain along the grain path.

9. The system of claim 1 additionally comprising a rubble removal apparatus configured to remove non-grain particles from the grain stream on the grain path.

10. The system of claim 1 wherein the second grinding apparatus comprising a second roller grinder.

11. The system of claim 1 wherein the second size of grain particles being smaller than the first size of grain particles.

12. The system of claim 1 additionally comprising a third grinding apparatus configured to grind grain exiting the sifting apparatus on the second diversion path by the second outlet, the third grinding apparatus having a third output in communication with the transfer apparatus such that ground grain particles exiting the third grinding apparatus through the third output are directed to the sifting apparatus;

a control apparatus configured to control an amount of grain in the grain stream moving along the grain path;

wherein the control apparatus comprises:

a sensor assembly configured to sense amounts of grain flow through components of the system; and an input control assembly configured to control movement of grain into the input based upon amounts of grain flow sensed by the sensor assembly;

wherein the sensor assembly comprising a plurality of sensors sensing amounts of power required by the components of the system to process grain moving along the grain path;

wherein the plurality of sensors includes at least one sensor sensing electrical power drawn by an electrical motor operating one of the grinding apparatus;

wherein the second particle removal stage receives grain particles from the first particle removal stage;

a magnetic material removal apparatus configured to remove magnetic material from the grain stream on the grain path;

wherein the first grinding apparatus comprises a first roller grinder;

a transfer apparatus configured to transfer grain from the first grinding apparatus to the sifting apparatus;

wherein the transfer apparatus comprises a conveyor configured to move grain along the grain path;

a rubble removal apparatus configured to remove non-grain particles from the grain stream on the grain path;

wherein the second grinding apparatus comprising a second roller grinder;

wherein the third grinding apparatus comprising a third roller grinder; and wherein the second size of grain particles being smaller than the first size of grain particles.

13. A system for grinding grain into particles, the system defining a grain path with an input for receiving grain to form a grain stream and an output stream for ground grain particles, the system comprising:

a first grinding apparatus configured to grind grain in the grain stream moving along the grain path into grain particles, the first grinding apparatus having a first output;

a sifting apparatus configured to receive ground grain particles from the first output of the first grinding apparatus and to remove grain particles having a size less than a threshold size from the grain path, the sifting apparatus diverting the ground grain particles less than the threshold size from the grain path to the output stream such that the ground grain particles of the output stream are not subjected to further grinding;

wherein the sifting apparatus comprises a first particle removal stage configured to remove grain particles of a first size and larger from the grain path as grain particles smaller than the first size continue along the grain path, the first particle removal stage diverting grain particles of the first size and greater to a first diversion path by a first outlet; and wherein the sifting apparatus comprises a second particle removal stage configured to remove grain particles of a second size and larger from the grain path after the grain particles have passed through the first particle removal stage and as grain particles smaller than the second size continue along the grain path, the second particle removal stage diverting grain particles of the second size and greater to a second diversion path by a second outlet; and a second grinding apparatus configured to grind grain exiting the sifting apparatus on the first diversion path by the first outlet, the second grinding apparatus having a second output in communication with the sifting apparatus such that ground grain particles exiting the second grinding apparatus through the second output are directed to the sifting apparatus;

a control apparatus configured to control an amount of grain in the grain stream moving along the grain path, and wherein the control apparatus comprises:

a sensor assembly configured to sense amounts of grain flow through components of the system; and an input control assembly configured to control movement of grain into the input based upon amounts of grain flow sensed by the sensor assembly.

14. The system of claim 13 wherein the sensor assembly comprising a plurality of sensors sensing amounts of power required by the components of the system to process grain moving along the grain path.

15. The system of claim 14 wherein the plurality of sensors includes at least one sensor sensing electrical power drawn by an electrical motor operating one of the grinding apparatus.

16. A method for grinding grain into particles in a grain stream on a grain path, the method comprising:

grinding grain of a grain stream moving along the grain path into grain particles using a first grinding apparatus having a first output;

sifting grain particles of the grain stream from the first output by a sifting apparatus to remove grain particles from the grain stream having a size less than a threshold size from the grain stream, and diverting a first portion of the grain particles having a size less than the threshold size from the grain path to the output stream such that the first portion of the grain particles of the output stream are not subjected to further grinding;

grinding a second portion of the grain stream from the sifting apparatus by a second grinding apparatus having a second output;

grinding a third portion of the grain stream from the sifting apparatus by a third grinding apparatus having a third output;

directing the second portion of the grain particles from the second output of the second grinding apparatus to the sifting apparatus and directing the third portion of the grain particles from the third output of the third grinding apparatus to the sifting apparatus; and resifting the second portion and third portion of the grain stream by the sifting apparatus to remove grain particles from the grain stream having a size less than a threshold size from the grain stream and diverting grain particles of the second and third portion having a size less than the threshold size from the grain path to the output stream.

17. The method of claim 16 wherein said sifting includes passing the grain particles of the grain stream through a first particle removal stage to remove grain particles of a first size and larger from the grain path as grain particles smaller than the first size continue along the grain path and diverting grain particles of the first size and greater to a first diversion path to the second grinding apparatus; and wherein said sifting includes passing the grain particles of the grain stream through a second particle removal stage to remove grain particles of a second size and larger from the grain path after the grain particles have passed through the first particle removal stage and as grain particles smaller than the second size continue along the grain path, and diverting the grain particles of the second size and greater to a second diversion path to the third grinding apparatus.

18. The method of claim 16 additionally comprising providing a control apparatus including at least one sensor configured to sense amounts of grain flow at one of the grinding apparatus; and controlling by the control apparatus an amount of grain in the grain stream moving along the grain path to the first grinding apparatus based upon an output of the at least one sensor.

19. The method of claim 16 additionally comprising recirculating the output of the second grinding apparatus and the output of the third grinding apparatus through the sifting apparatus for an additional pass.

20. The method of claim 16 additionally comprising recirculating an entirety of the output of the second grinding apparatus and an entirety of the output of the third grinding apparatus through the sifting apparatus for an additional pass.

* * * * *